US006205975B1

(12) United States Patent
Ruedin et al.

(10) Patent No.: US 6,205,975 B1
(45) Date of Patent: Mar. 27, 2001

(54) METHOD AND APPARATUS FOR CONTROLLING THE ACTUATION OF A COMPRESSION BRAKE

(75) Inventors: Joshua C. Ruedin, Peoria; Steven J. Funke, Princeville; Scott A. Leman, Eureka, all of IL (US); Matthew G. Mickiewicz, Clayton, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/464,835

(22) Filed: Dec. 16, 1999

(51) Int. Cl.[7] ..... F02D 13/04
(52) U.S. Cl. ..... 123/322
(58) Field of Search ..... 123/321, 322, 123/324

(56) References Cited

U.S. PATENT DOCUMENTS

| | | | | |
|---|---|---|---|---|
| 4,572,114 | | 2/1986 | Sickler | 123/21 |
| 4,688,384 | | 8/1987 | Pearman et al. | 60/600 |
| 4,706,624 | | 11/1987 | Meistrick et al. | 123/321 |
| 5,012,778 | | 5/1991 | Pitzi | 123/321 |
| 5,086,738 | | 2/1992 | Kubis et al. | 123/322 |
| 5,121,723 | | 6/1992 | Stepper et al. | 123/322 |
| 5,255,650 | | 10/1993 | Faletti et al. | 123/322 |
| 5,537,975 | * | 7/1996 | Cosma et al. | 123/322 |
| 5,603,300 | | 2/1997 | Feucht et al. | 123/322 |
| 5,619,964 | | 4/1997 | Feucht | 123/321 |
| 5,634,446 | | 6/1997 | Rauznitz et al. | 123/322 |
| 5,967,115 | * | 10/1999 | Konopka et al. | 123/322 |

* cited by examiner

*Primary Examiner*—Andrew M. Dolinar
(74) *Attorney, Agent, or Firm*—W. Bryan McPherson, III

(57) ABSTRACT

The present invention provides a method and apparatus for controlling an actuation of a compression brake associated with a combustion engine. The engine includes a fluid circuit for delivering a fluid to the compression brake. The engine also includes a cylinder having an associated exhaust valve. The method includes the steps of establishing a desired timing of an actuation of the brake, determining an air pressure of the engine, and determining a desired fluid pressure in response to the timing and the air pressure.

27 Claims, 7 Drawing Sheets

METHOD AND APPARATUS FOR CONTROLLING THE ACTUATION OF A COMPRESSION BRAKE

TECHNICAL FIELD

The present invention relates generally to engine compression release brakes, and more particularly, to a method and apparatus of controlling the actuation of a compression brake.

BACKGROUND ART

Engine retarding devices of the compression release type may utilized in work machines such as on-highway trucks and the like. A compression release brake assembly utilizes compression within the truck's engine to assist the truck's main braking system in order to slow the truck. In effect, such compression release brake assemblies convert the truck's internal combustion engine into an air compressor in order to develop retarding horsepower which is utilized to assist in slowing the truck.

Compression release brake assemblies which have previously been designed typically include a fluid system having a master cylinder having a piston which is actuated by a cam lobe or push rod associated with an exhaust valve, intake valve, or fuel injector corresponding to a first engine cylinder. Actuation of the piston associated with the master cylinder controls actuation of a piston associated with a slave cylinder which selectively opens and closes the exhaust vale of a second, different engine cylinder near the end of the compression stroke thereby causing the mechanical work performed during the compression stroke to be dissipated and hence not "recovered" during the subsequent power stroke.

In one embodiment of a hydraulically actuated compression brake, controlling the pressure of the hydraulic fluid may be useful in achieving the desired timing of the opening of the exhaust valve, with the desired force. As the cylinder pressure varies within a cylinder, the desired force for opening the exhaust valve also varies. Excessive exhaust actuation speed, which may be caused by excessive actuating fluid pressure, may cause a reduction in the service life of the exhaust valve. For example, if the actuating fluid pressure is too high, the lift of the exhaust valve may potentially overshoot and interfere with the piston, thereby potentially damaging the piston or valve. In addition, the faster the exhaust valve closes, which may be influenced by fluid pressure, the greater the velocity at which the exhaust valve seats. If the exhaust valve closes too rapidly, damage to the exhaust valve and/or the associated valve seat may occur. An inadequate actuating fluid pressure may result in the exhaust valve not being opened.

The present invention is directed to overcoming one or more of the problems identified above.

DISCLOSURE OF THE INVENTION

In one aspect of the present invention, a method of controlling an actuation of a compression brake associated with a combustion engine is disclosed. The engine has a fluid circuit for delivering a fluid to the compression brake. The engine also includes a cylinder having an associated exhaust valve. The method includes the steps of determining a desired timing of an actuation of the brake, determining an air pressure of the engine, and determining a desired fluid pressure in response to said timing and said air pressure.

In another aspect of the present invention, an apparatus adapted to control an actuation of a compression brake associated with a combustion engine is disclosed. The engine includes a fluid circuit for delivering a fluid to the compression brake, the fluid enabling the control of the compression brake. The engine includes a cylinder having an associated exhaust valve. The apparatus includes a speed sensor adapted to sense an engine characteristic indicative of an engine speed and responsively generate a speed signal, an air pressure sensor adapted to sense a characteristic indicative of an engine air pressure and responsively generate an air pressure signal, and a controller adapted to receive the speed signal and the air pressure signal, establish a desired timing of an actuation of said brake, determine an air pressure of said engine in response to said air pressure signal, and determine a desired fluid pressure in response the air pressure.

BEST MODE FOR CARRYING OUT THE INVENTION

Figure 1:
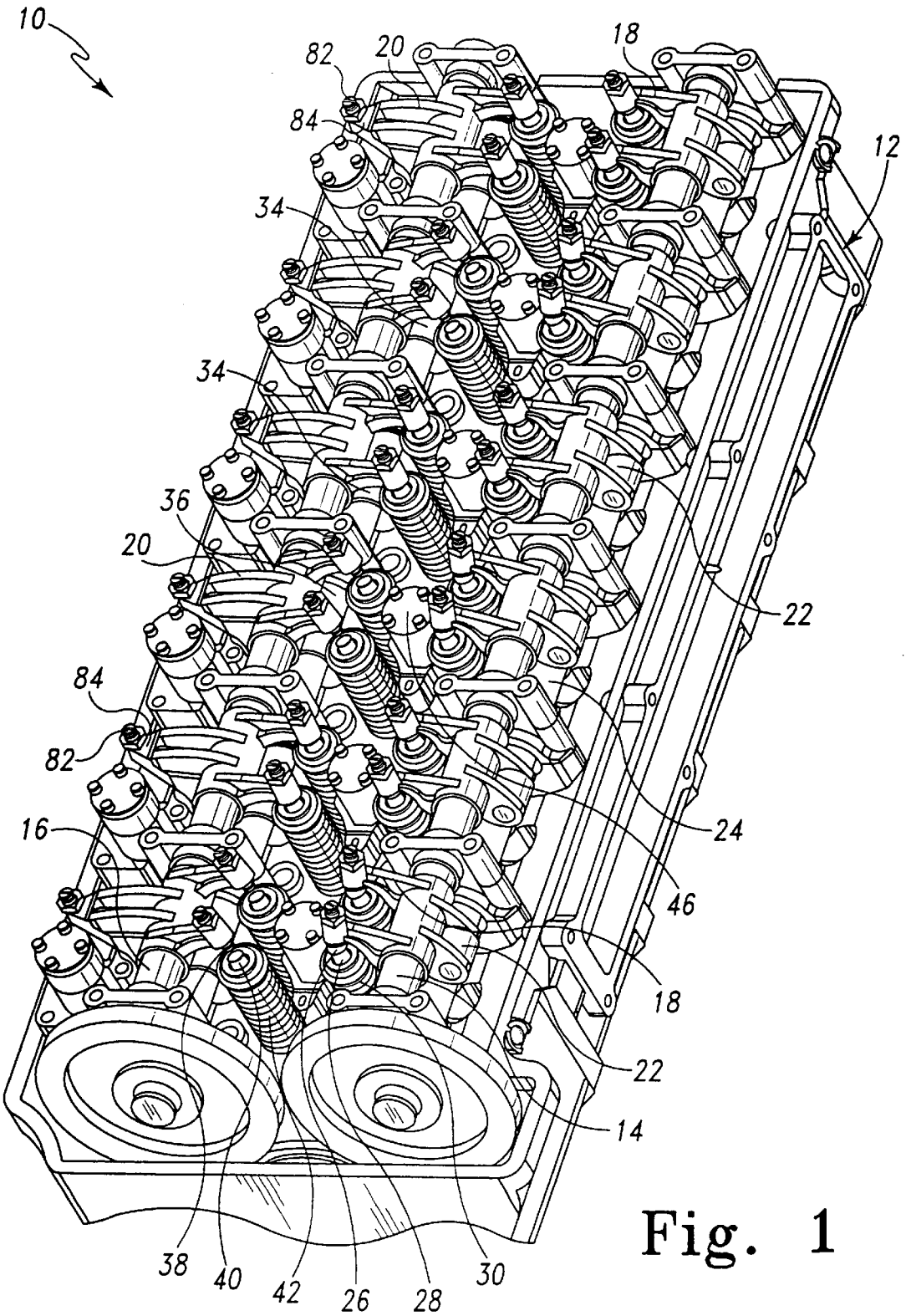
FIG. 1 is an internal combustion engine which incorporates the features of the present invention therein.
Figure 2:
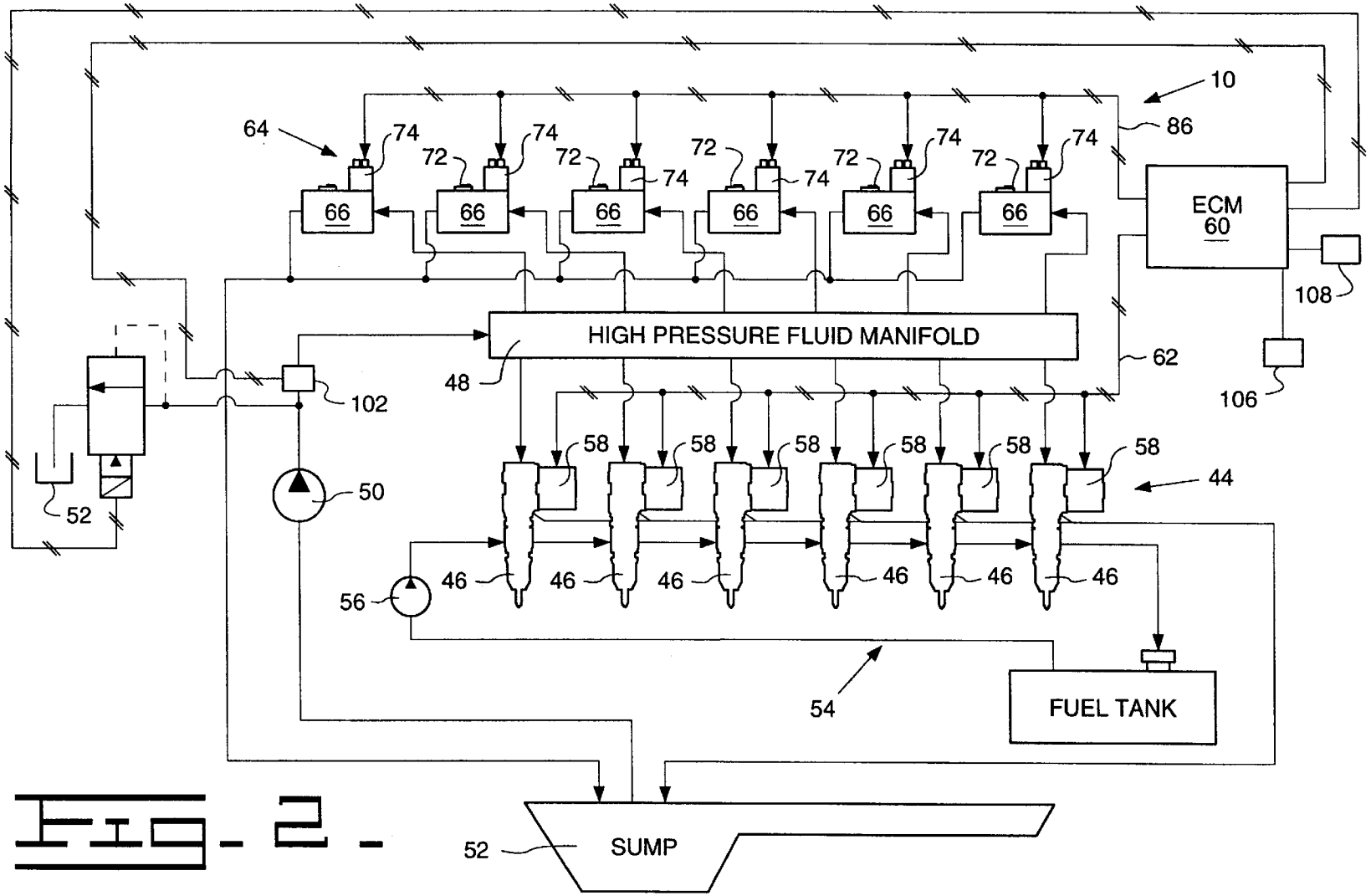
FIG. 2 is a schematic view of the internal combustion engine of FIG. 1.

The present invention provides a method and apparatus of controlling the actuation of a compression brake associated with a combustion engine. FIGS. 1 and 2, illustrate one embodiment of an internal combustion engine such as a diesel engine 10. The engine 10 is shown in the drawings, and will be described herein, as a six-cylinder diesel engine; however, it should be appreciated that the engine 10 of the present of invention could be embodied as any type of internal combustion engine with any number of cylinders.

The engine 10 includes an engine block and head assembly 12 having a pair of rocker arm shafts 14, 16 secured thereto. The rocker arm shaft 14 has a. number of intake rocker arms 18 rotatably secured thereto, whereas the rocker arm shaft 16 has a number of exhaust rocker arms 20 rotatably secured thereto. Each of the intake rocker arms 18 has a roller 22 coupled thereto which is selectively contacted by a number of cam lobes (not shown) associated with an intake cam shaft 24. In particular, rotation of the intake cam shaft 24 causes the cam lobes associated therewith to be selectively moved into and out of contact with the rollers 22 of each of the intake rocker arms 18. Contact with one of the intake rocker arms 18 by the cam lobes causes the intake rocker arm 18 to pivot or otherwise rotate about the rocker arm shaft 14 thereby causing a valve contact rod 26 associated with the intake rocker arm 18 to contact an upper portion of a valve stem 28 of an intake valve 30. Such contact with the upper portion of the valve stem 28 urges the intake valve 30 downwardly thereby opening the intake valve 30 so as to allow air to flow into the associated engine cylinder in a known manner.

Similarly, each of the exhaust rocker arms 20 has a roller 32 (see FIG. 4) coupled thereto which is selectively contacted by a number of cam lobes 34 associated with an exhaust cam shaft 36. In particular, rotation of the exhaust cam shaft 36 causes the cam lobes 34 to be selectively moved into and out of contact with the rollers 32 of each of the exhaust rocker arms 20. Contact with one of the exhaust rocker arms 20 by the cam lobes 34 causes the exhaust rocker arm 20 to pivot or otherwise rotate about the rocker arm shaft 16 thereby causing a valve contact rod 38 associated with the exhaust rocker arm 20 to contact an upper portion of a valve stem 40 of an exhaust valve 42. Such contact with the upper portion of the valve stem 40 urges the exhaust valve 42 downwardly thereby opening the exhaust valve 42 so as to allow gas within the associated engine cylinder to flow from the cylinder.

The engine 10 also includes a hydraulically-powered fuel injection system 44, as illustrated in FIG. 2. The fuel injection system 44 includes a number of fuel injectors 46 which are provided to selectively inject fuel into an associated engine cylinder. The hydraulically-powered fuel injection system 44 of the present invention may be provided as any known hydraulically-powered fuel injection system; however, one such hydraulically powered fuel injection system which is particularly useful as the hydraulically-powered fuel injection system 44 of the present invention is a Hydraulic Electronic Unit Injection (HEUI) system which is commercially available from Caterpillar, Incorporated of Peoria, Ill.

The hydraulic pump 50 is generally driven by the engine 10 and is provided to pump hydraulic fluid from a reservoir or sump 52 to the fluid manifold 48. Each of the fuel injectors 46 is fluidly coupled to the fluid manifold 48 such that fluid pressure from the manifold 48 may be utilized to generate a relatively high fuel pressure from the fuel within the fuel injectors 46. In particular, the engine 10 further includes a fuel system 54 which has a fuel pump 56 for pumping fuel to each of the fuel injectors 46. The fuel within the fuel injectors 46 is pressurized via a plunger assembly (not shown) which is driven by the fluid pressure from the fluid manifold 48.

Moreover, each of the fuel injectors 46 includes a high-speed, solenoid-actuated hydraulic valve 58 which is electrically coupled to an engine control module 60, or controller, via a wiring harness 62. In such a manner, the engine control module 60 may selectively generate injection pulses which are sent to the individual solenoid-actuated hydraulic valves 58 so as to open the valve 58 thereby increasing the fluid pressure exerted on the plunger assembly of the associated fuel injector 46 which in turn increases the fuel pressure within the injector 46. Such an increase in the fuel pressure within the fuel injector 46 causes fuel to be injected into the engine cylinder associated with the particular fuel injector 46. It should be appreciated that the engine control module 60 may operate the fuel injectors 46 in wide variety of manners in order to generate injection sequences and operation characteristics which fit the needs of a given engine 10.

Figure 3:
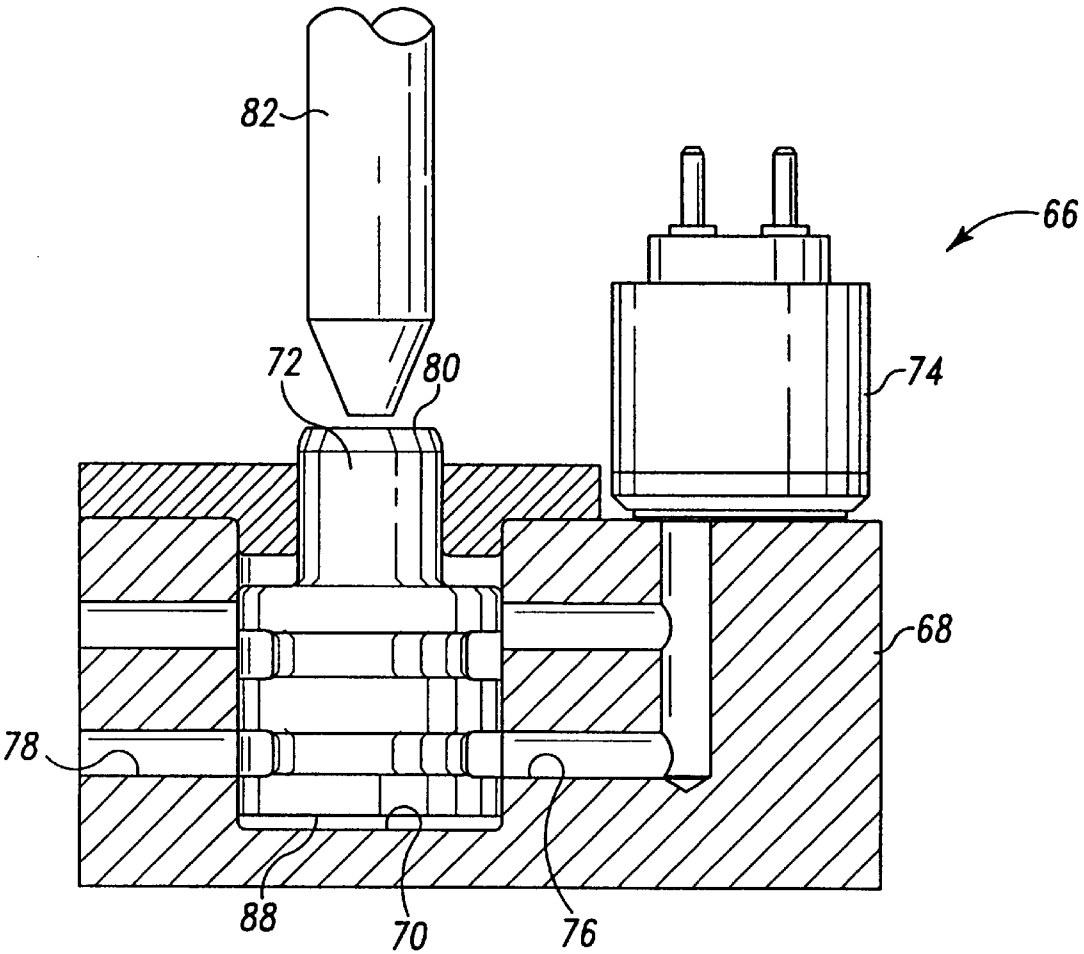
FIG. 3 is a cross sectional view of the actuator assembly of the compression release brake assembly of the internal combustion engine of FIG. 1, note that the solenoid-controlled hydraulic valve is not shown in cross section for clarity of description.

The engine 10 also includes a hydraulically-powered compression release brake assembly 64. The compression release brake assembly 64 includes a number of actuator assemblies 66 (see also FIG. 3) which are provided to selectively open the exhaust valves 42 associated with the engine 10 when the engine 10 is being operated in a brake mode of operation. Each of the actuator assemblies 66 includes a housing 68 having a fluid chamber 70 defined therein for housing a piston 72. Each of the actuator assemblies 66 also includes a high-speed, solenoid-actuated hydraulic valve 74. The solenoid-actuated hydraulic valves 74 are similar to the solenoid-actuated hydraulic valves 58. For example, one high-speed, solenoid-actuated hydraulic valve which may be utilized as the solenoid-actuated hydraulic valves 74 of the present invention are the solenoid-actuated hydraulic valves which are utilized to actuate the fuel injectors of the above-noted HEUI fuel injection system. Such solenoid-actuated hydraulic valves are likewise commercially available from Caterpillar.

The housing 68 of the actuator assembly 66 has a number of input fluid passages 76 and drain fluid passages 78 defined therein. The solenoid-actuated hydraulic valve 74 selectively couples the input fluid passages 76 to the fluid manifold 48. In particular, when the solenoid-actuated hydraulic valve 74 is positioned in an open position, pressurized hydraulic fluid is advanced from the fluid manifold 48, into an input port associated with the valve 74, out an output port associated with the valve 74, and into the input fluid passages 76 and hence the fluid chamber 70. The presence of pressurized hydraulic fluid in the fluid chamber 70 causes the piston 72 to be urged upwardly (as viewed in FIG. 3) and into an extended position in which a contact side 80 of the piston 72 is urged into contact with a portion of the exhaust rocker arm 20.

Figure 4:
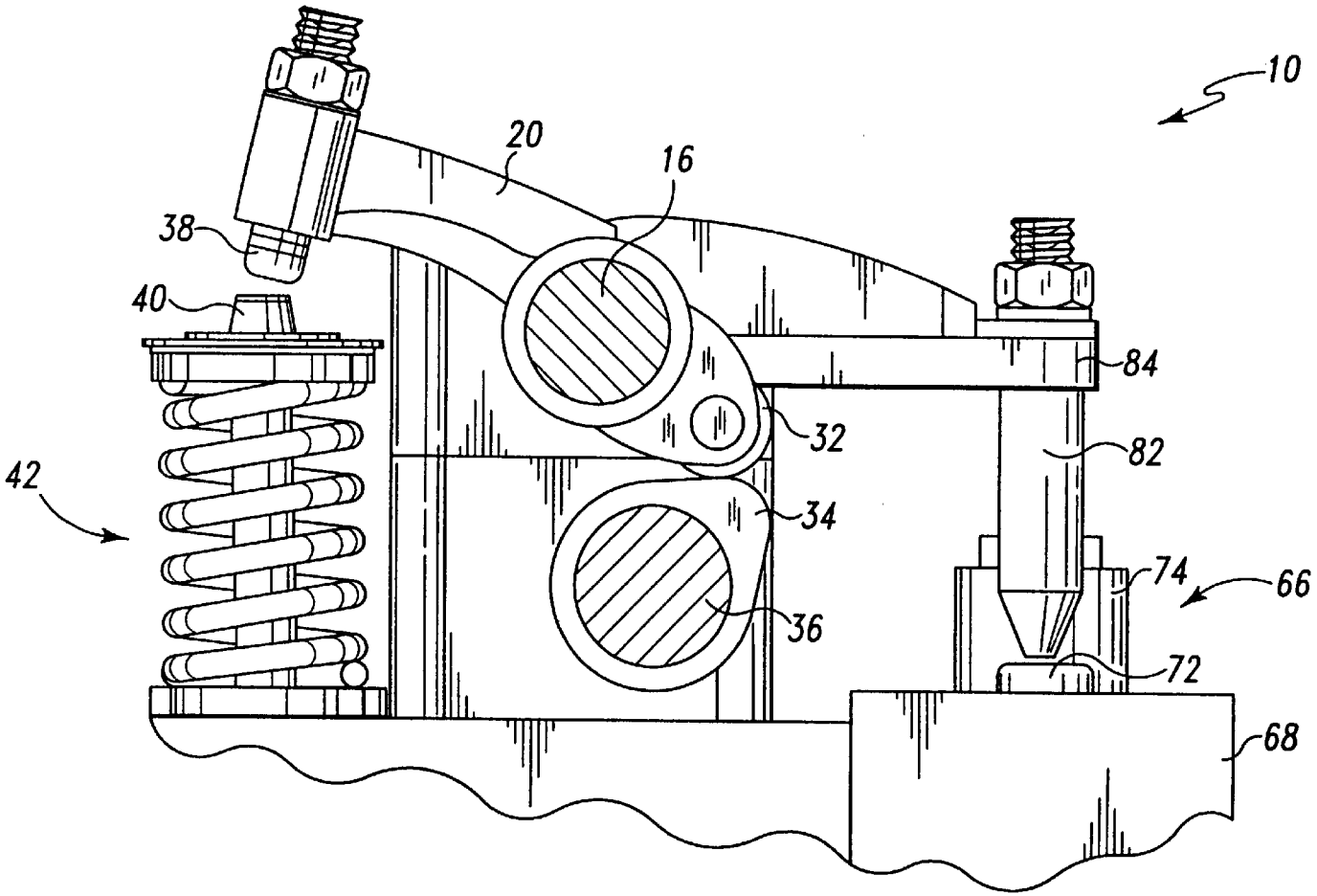
FIG. 4 is a side elevational view which shows the actuator assembly of the compression release brake assembly of FIG. 3 being utilized in the design of an overhead cam engine.

In particular, as shown in FIG. 4, a contact rod 82 is secured to an extension member 84 of each of the exhaust rocker arms 20. When the contact rod 82 is contacted by the piston 72, the contact rod 82 is urged upwardly (as viewed in FIG. 4) so as to urge the extension member 84 of the exhaust rocker arm 84 upwardly. Movement of the extension member 84 in an upward direction (as viewed in FIGS. 3 and 4) causes the exhaust rocker arm 20 to pivot or otherwise rotate about the rocker arm shaft 16 thereby causing the valve contact rod 38 associated with the exhaust rocker arm 20 to contact the upper portion of a valve stem 40 of the exhaust valve 42. Such contact with the upper portion of the valve stem 40 urges the exhaust valve 42 downwardly thereby opening the exhaust valve 42 so as to allow gas within the associated engine cylinder to flow from the cylinder. The speed sensor 106 enables the engine timing, e.g., piston position, to be monitored and determined.

It should be appreciated that operation of the actuator assemblies 66 is under the control of the engine control module 60. In particular, each of the solenoid-actuated hydraulic valves 74 is coupled to the engine control module 60 via a wiring harness 86. In such a manner, the engine control module 60 may selectively generate pulses which are sent to the individual solenoid-actuated hydraulic valves 74 so as to open the valve 74 thereby causing pressurized hydraulic fluid to be advanced from the fluid manifold 48 to a fluid side 88 of the piston 72 so as to urge the piston 72 upwardly (as viewed in FIG. 3). Such upward movement of the piston 72 causes rotation of the exhaust rocker arm 20 and hence opening of the exhaust valve 42 thereby allowing gas to be advanced out the associated engine cylinder. Once the exhaust valve has been opened for a period of time, the engine control module 60 ceases to generate a pulse on the wiring harness 86 thereby causing the particular exhaust valve 42 to be closed.

As shown in FIG. 4, there is a gap of a predetermined distance between the contact side 80 of the piston 72 and the lower surface of the contact rod 82 in order to prevent the exhaust valve 84 from being inadvertently held open during operation of the engine 10 which could potentially reduce the useful life of the exhaust valve 42.

The engine 10 also includes a speed sensor 106. The speed sensor 106 is adapted to sense a characteristic of the engine 10 that is indicative of engine speed and responsively deliver a speed signal to the controller 60. For example, in operation, the crankshaft (not shown) of the engine 10 rotates when the engine 10 is being operated. The rotation of the crankshaft results in the piston(s) of the engine moving between a top dead center position and a bottom dead center position. In one embodiment, the speed sensor 106 monitors the rotational position of the crankshaft and sends an associated signal to the controller 60. A particular piston position may be determined by correlating a piston position with the sensed crank angle position. Therefore, by monitoring the crank angle position, the piston position may be determined. The speed sensor 106 may be a crankshaft sensor that is disposed adjacent to the crankshaft flywheel (not shown). The sensor monitors the rotational position of the engine crankshaft and responsively produces a crankshaft pulse-train. The crankshaft sensor may be an optical or magnetic type sensor.

It should also be appreciated that the engine control module 60 controls operation of the fuel injectors 46 and the brake actuator assemblies 66 in order to control output from the engine 10. In particular, the engine 10 is operable in either a drive mode of operation or a brake mode of operation. When the engine 10 is being operated in its drive mode of operation, the engine control module 60 controls the fuel injectors 46 such that fuel is injected into the engine cylinders so as to cause combustion within the engine cylinders in order to produce positive mechanical output from the engine 10 thereby driving the drive train (not shown) of a work machine such as an on-highway truck. It should be noted that when the engine 10 is being operated in its drive mode of operation, the intake valves 30 and the exhaust valves 42 are operated in a known manner (i.e. selectively opened and closed) by the camshafts 24, 36, respectively, such that the intake valves 30 are opened during the intake stroke of the engine 10, whereas the exhaust valves 42 are opened during the exhaust stroke of the engine 10.

Moreover, when the engine 10 is operated in its drive mode of operation, the compression release brake assembly 64 is idled. In particular, during operation of the engine 10 in its drive mode of operation, the engine control module does not open any of the solenoid-controlled hydraulic valves 74 associated with actuator assemblies 66 thereby isolating the fluid chamber 70 from the fluid manifold 48. Such isolation of the fluid chamber 70 from the fluid manifold 48 positions the piston 72 in its retracted position thereby preventing it from contacting the contact rod 82.

Conversely, when the engine 10 is being operated in its brake mode of operation, the engine control module 60 controls the actuator assemblies 66 of the compression release brake assembly 64 such that the exhaust valves 42 are selectively opened in order to release compressed gas within the engine cylinders. In particular, the engine control module 60 may generate an output pulse which opens the solenoid-controlled valve 74 of a particular actuator assembly 66 thereby causing the piston 72 to urge the contact rod 82 upwardly which in turn opens the exhaust valve 42 in the manner described above.

Moreover, when the engine 10 is operated in its brake mode of operation, the fuel injection assembly 44 is idled. In particular, during operation of the engine 10 in its brake mode of operation, the engine control module 60 does not open any of the solenoid-controlled hydraulic valves 58 associated with the fuel injectors 46 thereby preventing fuel from being injected into the corresponding engine cylinders.

Figure 5:
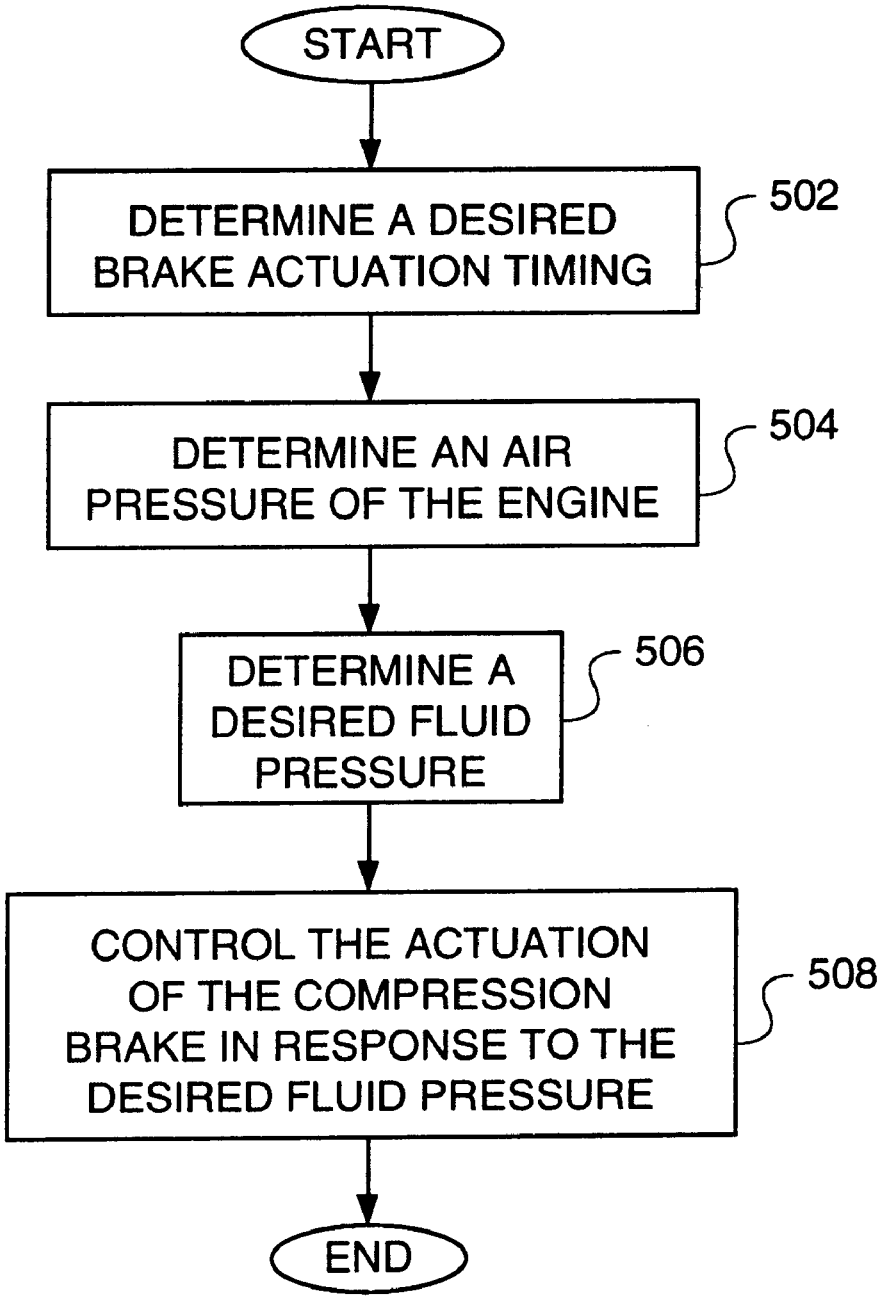
FIG. 5 illustrates a flow chart of one embodiment of the present invention.

In one embodiment, the controller 60 receives one or more sensor inputs and responsively controls an actuation of the compression brake. In one embodiment, the controller 60 establishes a desired timing of the brake actuation, determines an air pressure of the engine, determining a desired fluid pressure in response to the desired timing and the desired fluid pressure, and controls the brake actuation in response to the desired fluid pressure FIG. 5 illustrates one embodiment of a method of the present invention. In a first control block 502, a desired timing of the brake actuation is established. Establishing the desired brake actuation timing may be implementation dependent. In one embodiment, the timing may be dynamically determined in response to a desired engine speed and an actual engine speed. For example, a desired braking torque may be dynamically determined in response to the desired and actual engine speeds. A timing map may be utilized to dynamically determine a desired start of brake actuation timing in response to the desired braking torque and actual engine speed. In an alternative embodiment the desired timing may be a fixed value. For example, establishing the desired timing may include accessing a predetermined desired timing from memory within the controller 60.

In a second control block 504, the air pressure of the engine is determined. In the preferred embodiment, the air pressure to be determined is the boost pressure of the engine. An intake manifold pressure sensor 108 may be used to sense a parameter indicative of the boost pressure of the engine and responsively deliver a boost pressure signal to the controller 60. The intake manifold pressure sensor 108 may be a pressure transducer of any suitable commercially available type connected to and disposed into the intake manifold (not shown). In an alternative embodiment, to be discussed below, the air pressure to be determined may be the cylinder pressure within a respective cylinder.

Figure 6:
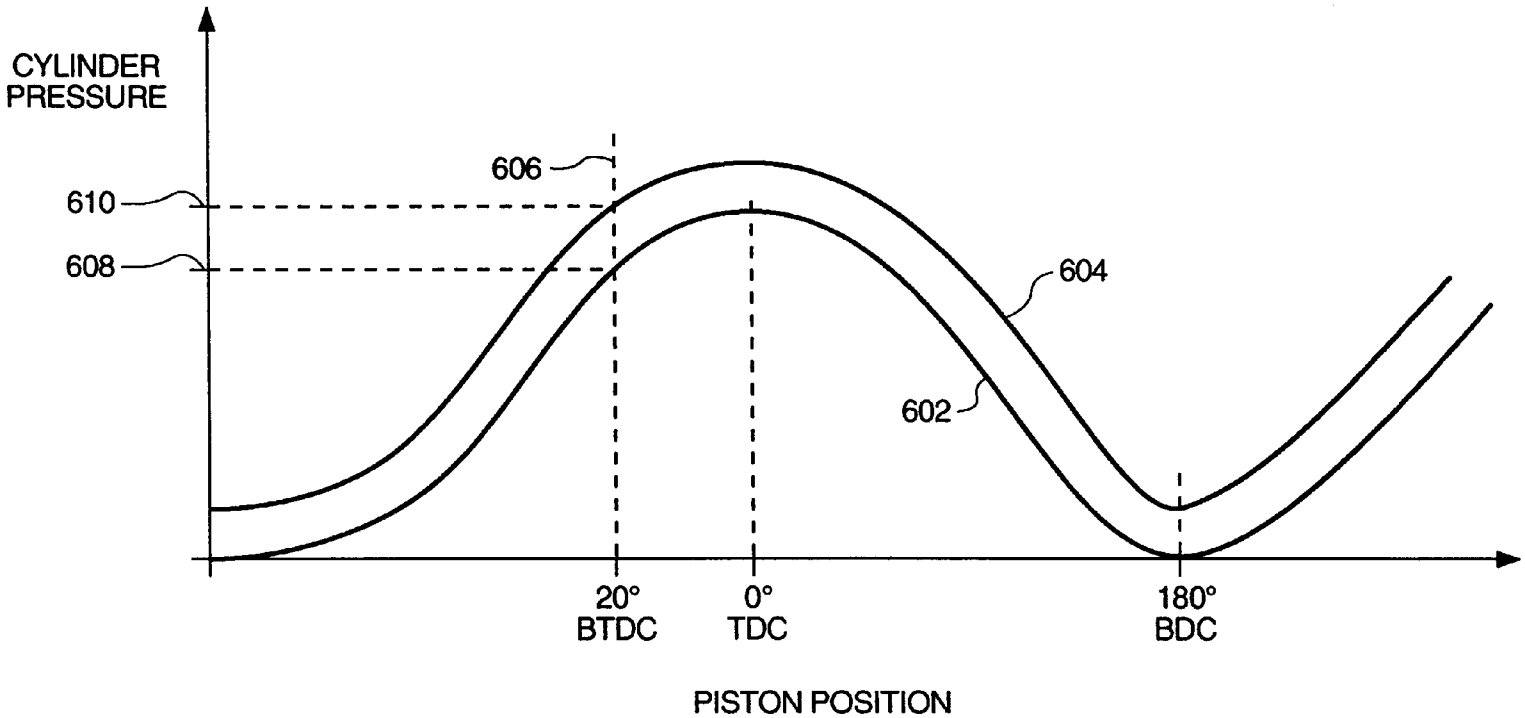
FIG. 6 illustrates one embodiment of a cylinder pressure map.

In a third control block 506 a desired fluid pressure may be determined in response to the desired timing of the brake actuation and the air pressure, e.g., boost pressure. In one embodiment, a cylinder pressure is determined in response to the desired actuation timing and the boost pressure. FIG. 6 illustrates a map of cylinder pressure correlated with piston position. The piston position illustrated in FIG. 6 may be indicative of the actual engine speed, or a representative illustration of the rotation of the piston. As discussed, piston position may be determined from a sensed crank angle position. Multiple pressure curves may be utilized in the map, representing different boost pressures. For example, a first cylinder pressure curve 602 correlates cylinder pressure with piston position for a first sensed boost pressure, e.g., one atmospheric pressure. A second cylinder pressure curve 604 correlates cylinder pressure with piston position for a second sensed boost pressure, e.g., two atmospheric pressures. In one embodiment, the cylinder pressure curves may be predetermined through empirical analysis of engine performance. The number of cylinder pressure curves utilized may be implementation dependent.

During operation, the boost pressure may be sensed. The cylinder pressure may then be determined in response to the boost pressure and the desired brake actuation timing. For example, in one embodiment, the pressure curve having an associated boost pressure closest to the sensed boost pressure may be utilized. For example, when the sensed boost pressure is closest to one atmosphere, the first pressure curve 602 may be utilized. Then, if the desired brake actuation timing, illustrated as desired timing 606, is twenty degrees before top dead center, the pressure within the cylinder may be determined to be a first cylinder pressure 608. That is, the first cylinder pressure 608 is indicative of the force needed to be overcome to achieve the desired actuation timing. The value of twenty degrees before top dead center is used here for exemplary purposes only.

In an alternative embodiment, if a sensed boost pressure falls between the boost pressure associated with the first pressure curve 602 and the boost pressure associated with the second pressure curve 604, then interpolation techniques may be used to determine the appropriate cylinder pressure.

Figure 7:
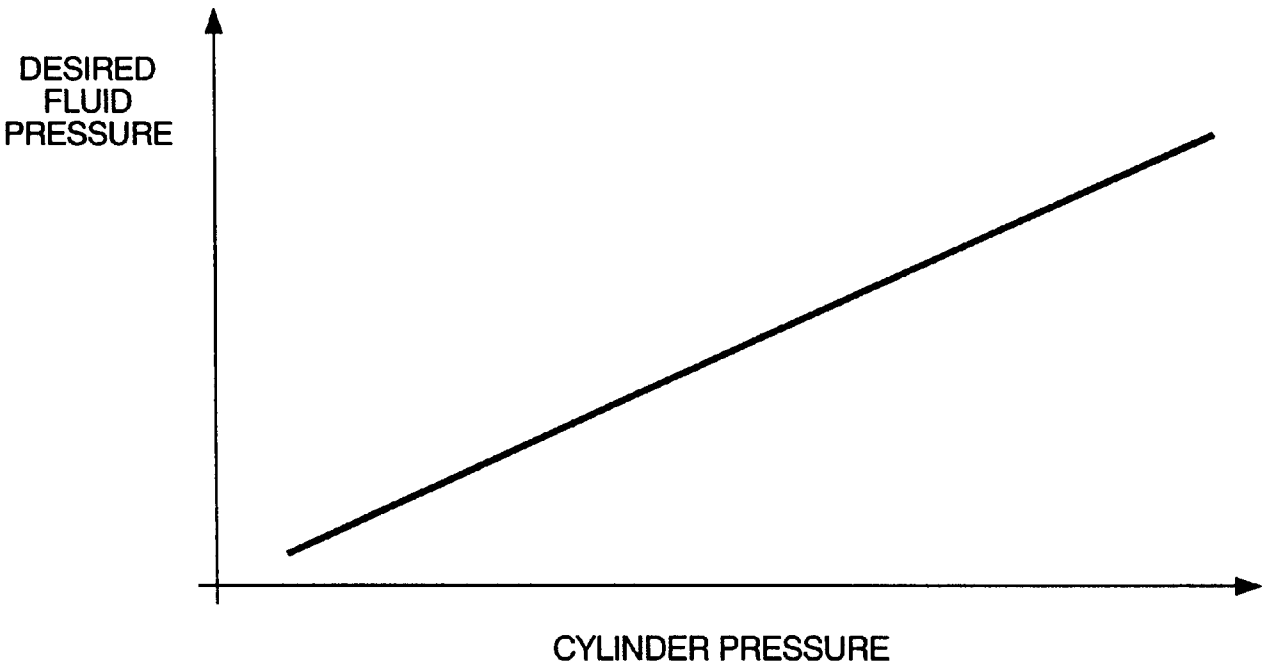
FIG. 7 illustrates one embodiment of a desired fluid pressure map.

Once a cylinder pressure has been determined, another map may be utilized which correlates cylinder pressure with desired fluid pressure. The desired fluid pressure is the pressure of the fluid needed to achieve the desired opening of the exhaust valve 42. Therefore, a desired fluid pressure map may be determined through empirical analysis to determine a desired fluid pressure that will enable a desired opening of the exhaust valve based upon the cylinder pressure. FIG. 7 illustrates a map correlating cylinder pressure with desired fluid pressure. The map may vary based upon desired valve opening, or valve lift. FIG. 7 is for exemplary purposes only. The actual values of the map are implementation and engine dependent, and may be empirically determined.

In an alternative embodiment, a single map may be used that correlates desired fluid pressure with desired brake actuation timing and boost pressure. The desired pressure values may be empirically determined, and then downloaded and stored in the controller 60 for use during the operation of the engine.

In a fourth control block 508, the actuation of the compression brake is controlled in response to the desired fluid pressure. As illustrated in FIG. 2, the engine 10 may include an Injector Actuation Pressure Control Valve (IAPCV) 104. In the preferred embodiment, the IAPCV 104 and the hydraulic pump 50 enable the controller 60 to maintain the desired pressure of the actuating fluid. For example, in one embodiment, a pressure sensor 102 senses the actual pressure of the actuating fluid and responsively delivers a fluid pressure signal to the controller 60. The controller 60 compares the actual fluid pressure and the desired fluid pressure and responsively delivers a command signal to the IAPCV 104 to achieve the desired fluid pressure. In one embodiment, the pump 50 is a variable displacement pump, and may be used to control the pressure of the actuating fluid. The controller 60 compares the actual fluid pressure and the desired fluid pressure and responsively delivers a command signal to the variable displacement pump 50 to achieve the desired fluid pressure.

In an alternative embodiment of the present invention, a desired brake actuation timing and an engine air pressure are determined. The engine air pressure determined is the actual cylinder pressure. A cylinder pressure sensor (not shown) may be used to sense the pressure within a cylinder and deliver a cylinder pressure signal to the controller 60. The cylinder pressure sensor may be disposed on the top of the piston. For example, the cylinder pressure sensor may be of a piezoelectric construction. Then, a cylinder pressure map, as illustrated in FIG. 7 may be used to correlate a desired fluid pressure with the cylinder pressure. The actuation of the brake may then be controlled in response to the desired fluid pressure.

In one embodiment, a temperature sensor (not shown) may be used to sense the temperature of the actuating fluid and deliver a corresponding signal to the controller 60. The temperature may be used to account for a viscosity of the actuating fluid. That is, the desired fluid pressure may vary as a result of changes in the viscosity of the actuating fluid. Therefore, the desired fluid pressure may be determined in response to the desired timing of the brake actuation, the boost pressure, and the fluid temperature. The impact of the fluid temperature on desired fluid pressure may be empirically determined and accounted for in the associated desired pressure maps.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

Industrial Applicability

In operation, the engine 10 of the present invention may be utilized to provide motive power to a work machine such as an on-highway truck or an off-highway work machine. The engine 10 is operated in its drive mode of operation in order to advance the truck. When the engine 10 is operated in its drive mode of operation, the engine control module 60 operates the fuel injectors 46 such that fuel is injected into the engine cylinders so as to cause combustion within the engine cylinders.

When the engine 10 is operated in its drive mode of operation, the compression release brake assembly 64 is idled. In particular, during operation of the engine 10 in its drive mode of operation, the engine control module 60 does not open any of the solenoid-controlled hydraulic valves 74 associated with actuator assemblies 66 thereby isolating the fluid chamber 70 from the fluid manifold 48. Such isolation of the fluid chamber 70 from the fluid manifold 48 positions the piston 72 in its retracted position thereby preventing it from contacting the contact rod 82.

However, during braking of the truck, such as downhill braking or the like, the operator of the truck (or the engine control module 60 itself) may switch the engine 10 into its brake mode of operation in order to assist the truck's main braking system in the slowing of the truck. When the engine 10 is being operated in its brake mode of operation, the engine control module 60 controls operation of the actuator assemblies 66 of the compression release brake assembly 64 such that the exhaust valves 42 are selectively opened in order to release compressed gas within the engine cylinders. In particular, the engine control module 60 generates an output pulse which opens the solenoid-controlled hydraulic valve 74 of the actuator assembly 66 associated with the particular piston/engine cylinder. Opening of the solenoid-controlled hydraulic valve 74 allows pressurized hydraulic fluid from the fluid manifold 48 to be advanced through the solenoid-controlled hydraulic valve 74 and into the fluid chamber 70 of the actuator assembly 66. The presence of pressurized hydraulic fluid in the fluid chamber 70 causes the piston 72 to be urged upwardly (as viewed in FIG. 3) into an extended position in which the contact side 80 of the piston 72 is urged into contact with a portion of the exhaust rocker arm 20.

Moreover, when the engine 10 is operated in its brake mode of operation, the fuel injection assembly 44 is idled. In particular, during operation of the engine 10 in its brake mode of operation, the engine control module 60 does not open any of the solenoid-controlled hydraulic valves 58 associated with the fuel injectors 46 thereby preventing fuel from being injected into the corresponding engine cylinders.

During operation of a hydraulic compression brake, if a fluid pressure that is too low is applied during brake actuation, the pressure may not create enough force to enable the opening of the exhaust valve 42. A fluid pressure to large may cause the lift of exhaust valve 42 to overshoot and potentially contact the cylinder piston 72. In addition, an excessive fluid pressure may cause an excessive exhaust valve actuation speed, which may cause the valve 42 to close with a strong return force, potentially prematurely wearing down the components involved.

The present invention provides a method and apparatus of controlling the actuation of a compression brake associated with a combustion engine The engine includes a fluid circuit for delivering a fluid to the compression brake. The method includes the steps of: establishing a desired timing of the actuation of the brake, determining the air pressure of the engine, determining the desired fluid pressure in response to the timing and the air pressure; and controlling the compression brake in response to the desired fluid pressure.

The application of pressurized fluid against the piston 72 creates a force that is applied to an engine cylinder's exhaust valve 42. The timing of the actuation is done to open the cylinder's exhaust valve 42 when the associated piston, or crank angle, has achieved a desired position within the piston cycle, e.g., the compression stroke. When opened, the compressed air passes through the exhaust valve 42, thereby dissipating energy. The energy loss results in a retarding torque on the crankshaft that helps slow down the speed of the engine. Achieving the desired opening of the exhaust valve against the cylinder pressure varies, in part, on boost pressure and desired brake actuation timing, e.g., piston position, or crank angle position. Therefore, the present invention preferably dynamically determines a desired brake actuation time, and senses the air pressure, e.g., boost pressure, of the engine. A. desired fluid pressure is then determined in response to the desired timing and the boost pressure. The compression brake is then controlled in response to the desired fluid pressure, thereby enabling the desired release of compressed air through the exhaust valve.

Other aspects, objects, and advantages of the present invention can be obtained from a study of the drawings, the disclosure, and the claims.

What is claimed is:

1. A method of controlling an actuation of a compression brake associated with a combustion engine, the engine including a fluid circuit for delivering a fluid to the compression brake, the fluid enabling the control of the compression brake, the engine including a cylinder having an associated exhaust valve, comprising the steps of:

establishing a desired timing of an actuation of said brake;

determining an air pressure of said engine;

determining a desired fluid pressure in response to said timing and said air pressure; and controlling said compression brake actuation in response to said desired fluid pressure.

2. A method, as set forth in claim 1, wherein the step of establishing a desired brake actuation timing includes the step of dynamically determining said desired brake actuation timing.

3. A method, as set forth in claim 1, wherein said desired brake actuation timing is a predetermined value.

4. A method, as set forth in claim 2, wherein the step of dynamically determining said desired brake actuation timing further comprises the steps of:

determining a desired engine speed;

determining an actual engine speed;

determining a desired braking torque in response to said desired and actual engine speeds;

determining a desired brake actuation timing in response to said desired braking torque and said actual engine speed.

5. A method, as set forth in claim 2, wherein the step of determining an air pressure includes the step of determining a boost pressure of said engine.

6. A method, as set forth in claim 5, wherein the step of determining a boost pressure includes the step of sensing said boost pressure.

7. A method, as set forth in claim 6, wherein the step of determining said desired brake timing includes the step of determining an actual engine speed.

8. A method, as set forth in claim 7, further including the step of determining a cylinder pressure in response to said boost pressure and said desired brake timing.

9. A method, as set forth in claim 8, wherein the step of determining said cylinder pressure further includes the steps of:

correlating said desired brake timing with an engine speed; and determining said cylinder pressure in response to said boost pressure and said correlation.

10. A method, as set forth in claim 9, wherein said engine speed is an actual engine speed.

11. A method, as set forth in claim 9, wherein said engine speed is indicative of an associated piston position, and wherein said the step of correlating said desired brake timing with said engine speed includes the step of correlating said desired brake timing with said associated piston position.

12. A method, as set forth in claim 11, wherein the step of determining said desired fluid pressure further includes the step of determining said desired fluid pressure in response to said cylinder pressure.

13. A method, as set forth in claim 1, wherein the step of controlling said brake actuation includes the step of controlling an exhaust valve actuation speed.

14. A method, as set forth in claim 1, wherein the step of controlling said brake actuation includes the step of controlling an exhaust valve lift.

15. A method, as set forth in claim 1, wherein the step of determining said air pressure includes the steps of:

sensing a signal indicative of an engine cylinder pressure; and determining a cylinder pressure in response to said sensed cylinder pressure signal.

16. A method, as set forth in claim 15, wherein the step of determining said desired fluid pressure includes the step of determining said desired fluid pressure in response to said cylinder pressure.

17. An apparatus adapted to control an actuation of a compression brake associated with a combustion engine, the engine including a fluid circuit for delivering a fluid to the compression brake, the fluid enabling the control of the compression brake, the engine including a cylinder having an associated exhaust valve, comprising:

a speed sensor adapted to sense an engine characteristic indicative of an engine speed and responsively generate a speed signal;

an air pressure sensor adapted to sense a characteristic indicative of an engine air pressure and responsively generate an air pressure signal; and a controller adapted to receive said speed signal and said air pressure signal, establish a desired timing of an actuation of said brake, determine an air pressure of said engine in response to said air pressure signal, dynamically determine a desired fluid pressure in response to said brake timing and said air pressure, and control said compression brake actuation in response to said desired fluid pressure.

18. An apparatus, as s et forth in claim 17, wherein said controller is further adapted to establish said desired timing dynamically in response to said sensed engine characteristic and a desired engine speed.

19. An apparatus, as set forth in claim 18, wherein said air pressure sensor is a sensor adapted to sense a characteristic of an engine boost pressure.

20. An apparatus, as set forth in claim 19, wherein said air pressure sensor is a sensor adapted to sense a characteristic of an engine cylinder pressure.

21. An apparatus, as set forth in claim 20, further comprising a fluid pressure sensor, said fluid pressure sensor adapted to sense an actual pressure of said fluid and responsively generate a fluid pressure signal.

22. An apparatus, as set forth in claim 21, wherein said controller is further adapted to receive said fluid pressure signal, compare said actual fluid pressure with said desired fluid pressure, and control said brake actuation in response to said comparison.

23. An apparatus, as set forth in claim 22, further including a control valve adapted to receive a fluid pressure command signal and control said actual fluid pressure in response to said command signal, wherein said controller is further adapted to generate said command signal in response to said comparison.

24. An apparatus, as set forth in claim 22, further including a pump adapted to receive a fluid pressure command signal and control said actual fluid pressure in response to said command signal, wherein said controller is further adapted to generate said command signal in response to said comparison.

25. An apparatus, as set forth in claim 18. wherein said controller is further adapted to determine a cylinder pressure in response to said air pressure and said desired timing.

26. An apparatus, as set forth in claim 25, wherein said controller is further adapted to dynamically determine said desired fluid pressure in response to said cylinder pressure.

27. An apparatus, as set forth in claim 25, further comprising a temperature sensor adapted to sense a temperature of said fluid and generate a temperature signal, wherein said controller is further adapted to receive said temperature signal and determine said desired fluid pressure in response to said cylinder pressure and said fluid temperature.

* * * * *